US007519185B2

(12) United States Patent
Liang

(10) Patent No.: US 7,519,185 B2
(45) Date of Patent: Apr. 14, 2009

(54) EARPHONE DETECTION CIRCUIT

(75) Inventor: Chan-Li Liang, Tai-nan Hsien (TW)

(73) Assignee: HTC Corporation, Taoyuan County (TW)

( * ) Notice: Subject to any disclaimer, the term of this patent is extended or adjusted under 35 U.S.C. 154(b) by 581 days.

(21) Appl. No.: 10/063,277

(22) Filed: Apr. 8, 2002

(65) Prior Publication Data

US 2008/0139042 A1 Jun. 12, 2008

(30) Foreign Application Priority Data

Feb. 15, 2002 (TW) ..... 91102578 A

(51) Int. Cl.
*H04R 1/10* (2006.01)

(52) U.S. Cl. ..... 381/74; 381/77; 439/669

(58) Field of Classification Search ..... 381/74, 381/384, 111, 58, 77, 124; 439/669, 488, 439/668, 577

See application file for complete search history.

(56) References Cited

U.S. PATENT DOCUMENTS 4,672,663 A * 6/1987 Tomasi ..... 379/388.01
5,794,163 A * 8/1998 Paterson et al. ..... 455/575.2
6,856,046 B1 * 2/2005 Scarlett et al. ..... 307/125
7,167,569 B1 * 1/2007 Seven ..... 381/111

* cited by examiner

*Primary Examiner*—Vivian Chin
*Assistant Examiner*—Con P Tran
(74) *Attorney, Agent, or Firm*—Jianq Chyun IP Office

(57) ABSTRACT

An earphone detection circuit that comprises a transistor, a first resistor, a second resistor, a third resistor and a detector. The transistor has a first terminal, a second terminal, a third terminal and a fourth terminal. The first and the fourth terminal of the transistor are electrically connected to an operating voltage. One end of the first resistor is electrically connected to the first terminal of the transistor and the other end of the first resistor is electrically connected to the second terminal of the transistor. One end of the second resistor is electrically connected to the third terminal of the transistor and the other end is electrically connected to a ground terminal. One end of the third resistor is electrically connected to the second terminal of the transistor and the other end is electrically connected to the detection terminal of an earphone driving circuit. One end of a capacitor is electrically connected to the second terminal of the transistor and the other end is electrically connected to the ground terminal. The detector is electrically connected to the third terminal of the transistor.

12 Claims, 6 Drawing Sheets

EARPHONE DETECTION CIRCUIT

CROSS REFERENCE TO RELATED APPLICATIONS

This application claims the priority benefit of Taiwan application serial no. 91102578, filed Feb. 15, 2002.

BACKGROUND OF INVENTION

1. Field of Invention

The present invention relates to an earphone detection circuit. More particularly, the present invention relates to an earphone detection circuit without a common ground terminal for left and right audio channel.

2. Description of Related Art

At present, most audio signal providers such as audio recorders, camcorders, televisions or portable computers have two major audio output channels. Aside from having a built-in speaker, these audio signal providers also have a socket for plugging an earplug so that people may listen through an earphone. In addition, these audio signal providers have an automatic detector inside for switching the audio attendance mode automatically. In other words, audio signals are channeled to the earphone or other externally plugged device once the earplug is plugged into the socket. Conversely, if the socket is unoccupied, audio signals will be re-routed to built-in devices such as a pair of speakers.

However, to provide a function for the automatic switching of output pathways, a suitable earphone driving circuit must be present so that the occupation of an earphone (or other output device) can be detected. FIG. 1 is a conventional earphone driving circuit and corresponding earphone detection circuit. In FIG. 1, the left and right audio channels are amplified through amplifiers 102 and 104 respectively. Thereafter, the direct current (DC) components of the amplified signals are filtered through capacitors 106 and 108. Finally, the signals are passed to the earphone through contact points 118 and 120 respectively. In the absence of an earplug inside the socket, contact point 124 and the audio signal transmission line 112 are in contact. Since the resistance of the resistor 122 is a lot higher than the resistance of the resistor 126, a detector 130 is able to detect a zero voltage from a detection line 132. In this way, the detector 130 will correctly determine the absence of an earplug inside the socket. Consequently, transmission of audio signals via the earphone driving circuit is prevented. On the other hand, if an earplug is plugged into the socket, contact point 124 is forced away from the audio signal transmission line 112. Thus, the detector 130 will receive a voltage of about Vcc. Again, the detector 130 will correctly determine the presence of an earplug. Ultimately, the audio signal is transmitted through the earphone driving circuit Although everything seems fine with this circuit arrangement, the capacitors must have a large capacitance and hence tend to occupy a large volume. This is because a larger capacitance is needed to produce a better frequency response. Thus, reducing overall volume of the earphone driving circuit is difficult.

To resolve the bulky capacitor problem, an earphone driving circuit without any capacitor as shown in FIG. 2A is developed. As shown in FIG. 2A, since potential at a central point serves as a common ground terminal, an earphone detection circuit 230 composed of the resistors 122 and 126 and the detection line 132 as shown in FIG. 1 cannot be used. Therefore, a special earphone detection circuit 230 suitable for an earphone driving circuit is required.

In brief, the conventional technique for detecting the presence of earphone either contains bulky circuits or is not very effective.

SUMMARY OF INVENTION

Accordingly, one object of the present invention is to provide an earphone detection circuit without any capacitors therein. The earphone detection circuit together with an earphone driving circuit detects the presence or absence of an earphone and channels any audio signals to a correct circuit according to the result of detection.

To achieve these and other advantages and in accordance with the purpose of the invention, as embodied and broadly described herein, the invention provides an earphone detection circuit for detecting the plugging/unplugging state of an earphone driving circuit. The earphone driving circuit includes a left audio channel terminal, a right audio channel terminal, a virtual ground terminal and a detection terminal. The earphone detection circuit includes a transistor, a plurality of resistors, a capacitor and a detector. The transistor has four connective terminals. The first terminal and the fourth terminal are connected together electrically and both receive an operating voltage. A terminal of a first resistor and the first terminal of the transistor are electrically connected. The other terminal of the first resistor and the second terminal of the transistor are electrically connected. A terminal of a second resistor and the third terminal of the transistor are electrically connected together. The other terminal of the second resistor is connected to a ground terminal. A terminal of a third resistor and the second terminal of the transistor are electrically connected together. The other terminal of the third resistor and the detection terminal of the earphone driving circuit are electrically connected together. One end of the capacitor is electrically connected to the second terminal of the transistor while the other end of the capacitor is electrically connected to the ground terminal. The detector is electrically connected to the third terminal of the transistor.

In a second embodiment of this invention, the capacitor within the earphone detection circuit is deleted. The second terminal of the transistor and the electrically connected portion of the third resistor, the first resistor and the second terminal of the transistor are all connected to the ground terminal. Although the circuit module having this rearrangement may produce a circuit with an inferior resistor-capacitor effect, the elimination of the capacitor reduces overall volume occupation of the circuit.

In summary, major advantages include the following. This invention utilizes the difference in conductive status when a voltage differential exists between the gate terminal of the transistor and the source/drain terminal to facilitate the attachment of an earphone detection circuit to an earphone driving circuit originally incapable of detecting plugging/unplugging status. Hence, aside from reducing overall dimensions of the earphone driving circuit, the audio signal output device is able to retain automatic audio signal switching capacity.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

Figure 1:
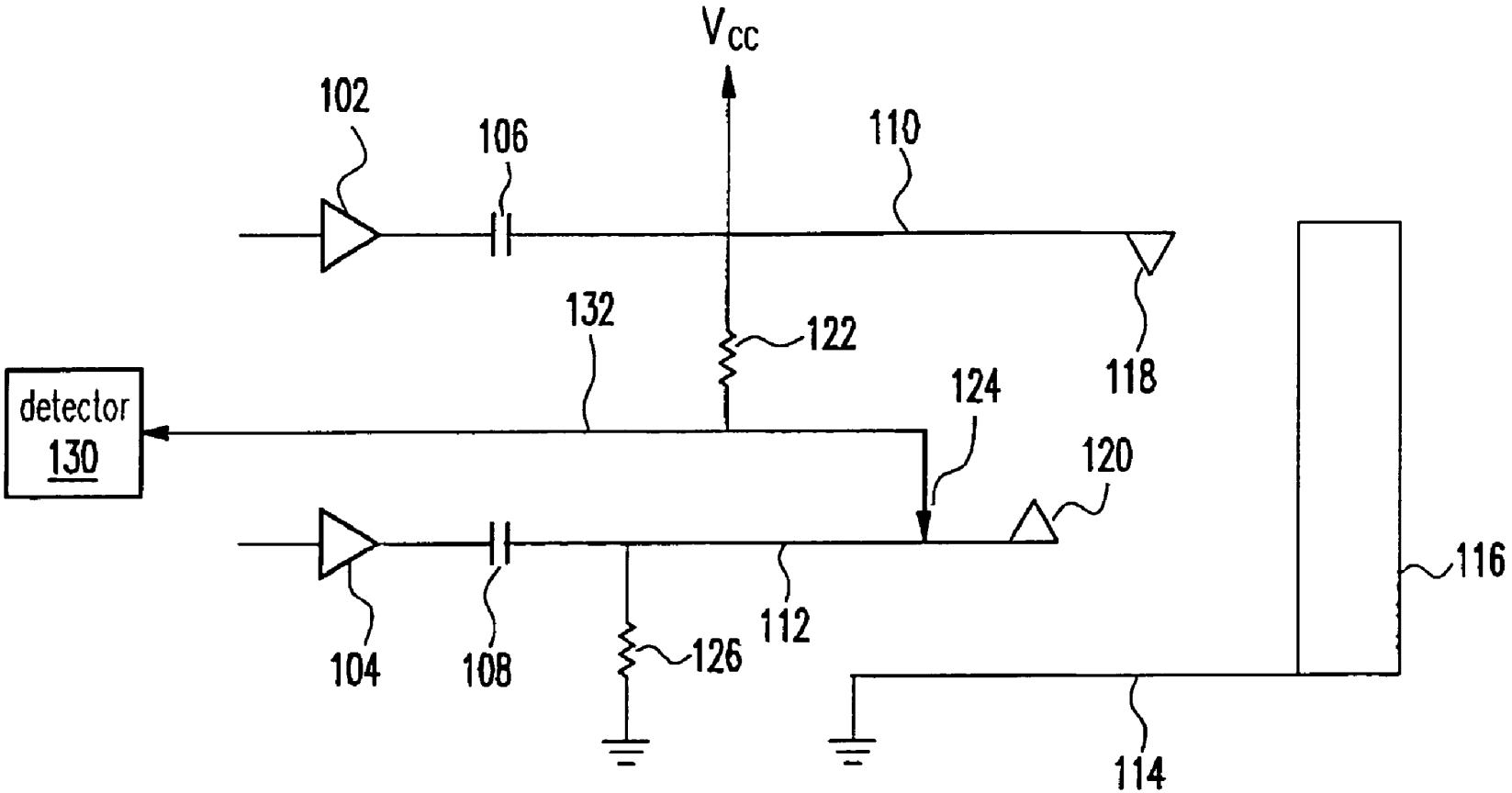
FIG. 1 (PRIOR ART)
FIG. 1 is a conventional earphone driving circuit and corresponding earphone detection circuit.

Reference will now be made in detail to the present preferred embodiments of the invention, examples of which are illustrated in the accompanying drawings. Wherever possible, the same reference numbers are used in the drawings and the description to refer to the same or like parts.

Figure 2A:
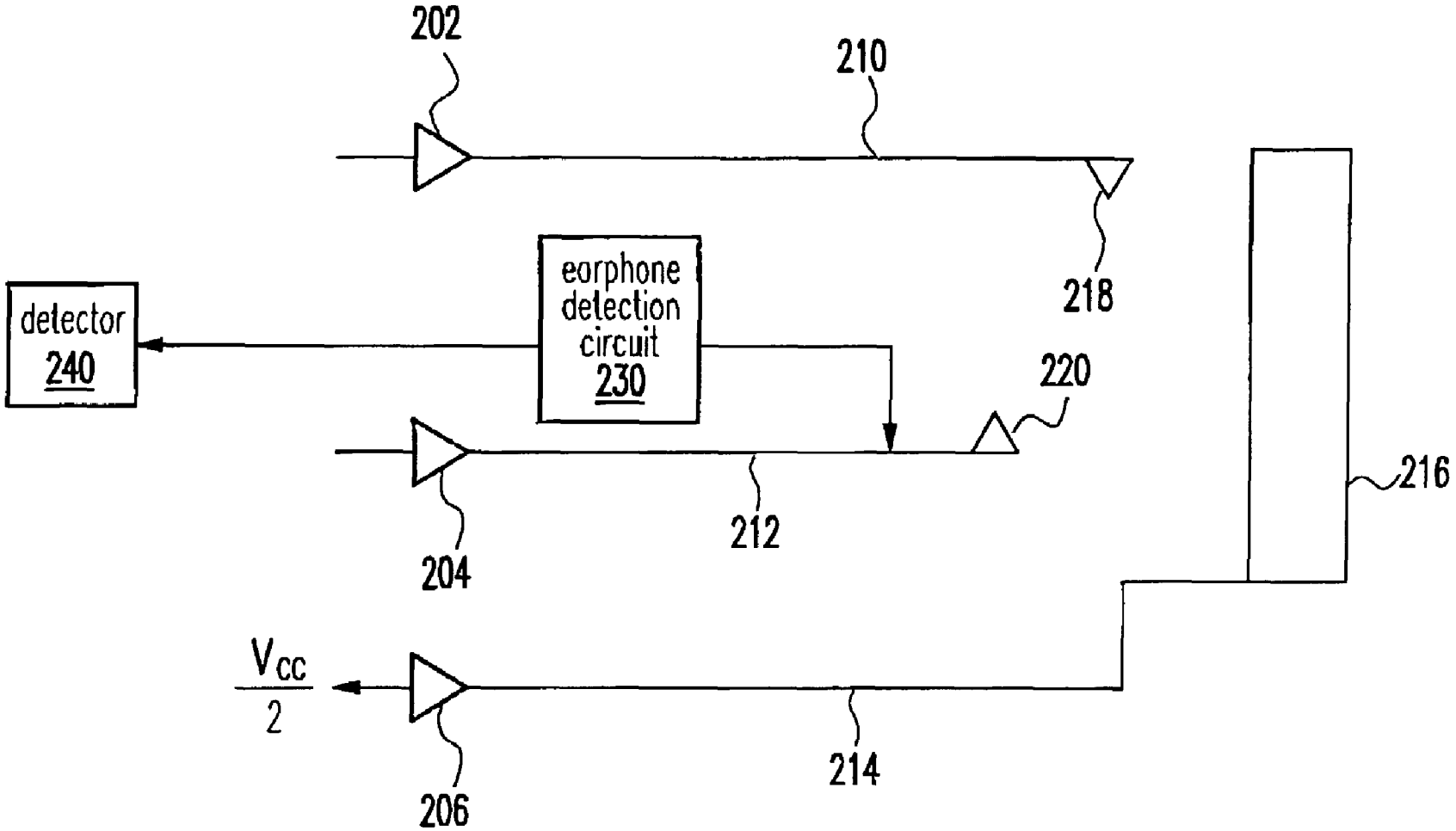
FIG. 2A(PRIOR ART)
FIG. 2A is a diagram of a conventional earphone driving circuit.
Figure 2B:
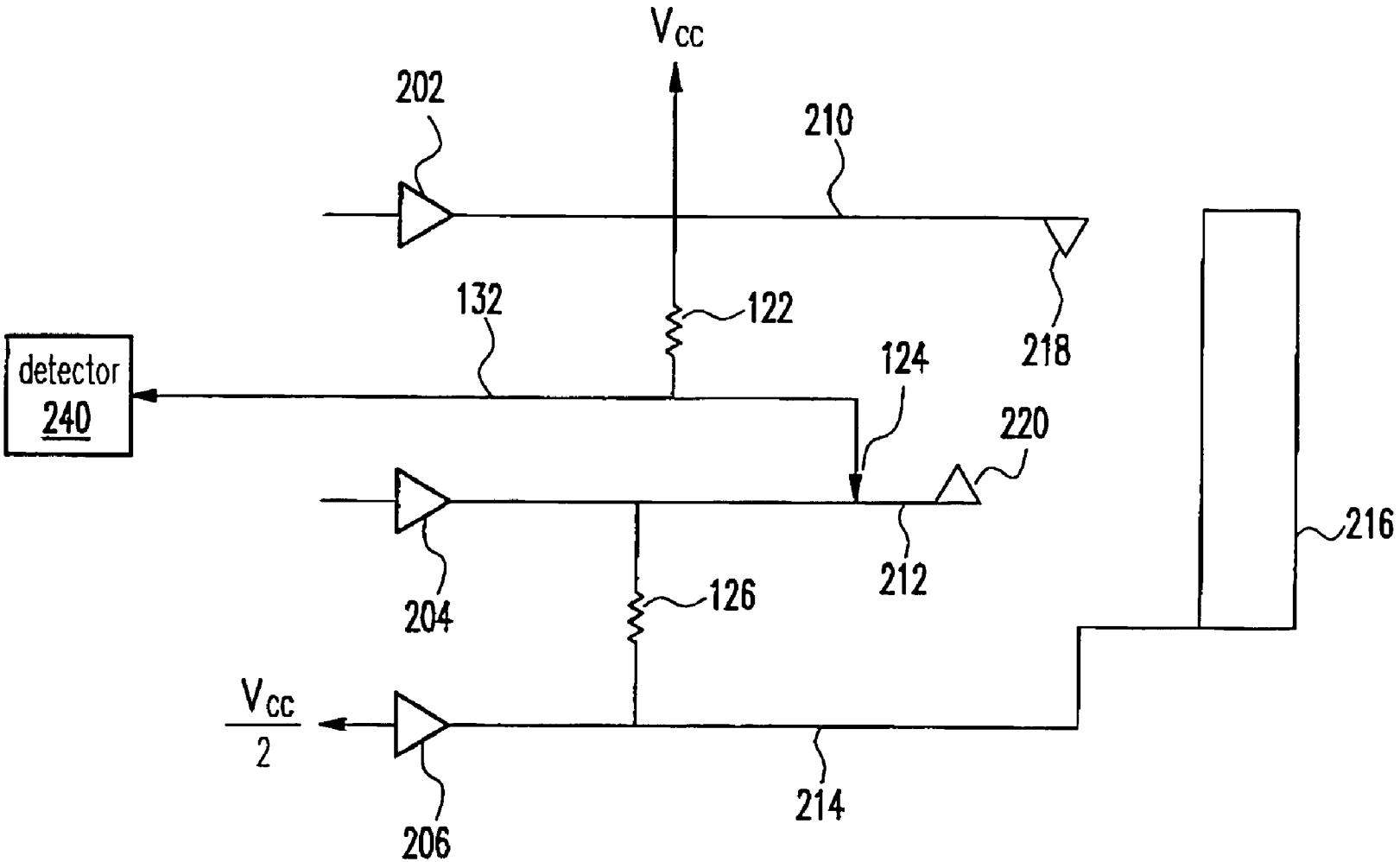
FIG. 2B(PRIOR ART)
FIG. 2B is a diagram showing a circuit that combines the earphone driving circuit in FIG. 2A with the earphone detection circuit in FIG. 1.

To familiarize the innovation in this invention, a conventional earphone driving circuit is briefly introduced with reference to FIG. 2A. In FIG. 2A, the earphone driving circuit has no actual ground connection. The earphone driving circuit is connected to a virtual ground line 214 having a virtual ground voltage of about Vcc/2. When the portion including the resistors 122 and 126 and the detection line 132 as shown in FIG. 1 is used as an earphone detection circuit 230, the entire circuit is shown in FIG. 2B. Note that the elements in FIG. 2B identical to the ones shown in FIGS. 1 and 2A are labeled identically.

As shown in FIG. 2B, the audio signal transmission line 212 is at a voltage Vcc/2 due to direct current voltage bias when the earphone is absent. Hence, the detector 240 detects a voltage of about Vcc/2 on the detection line 132. However, the digital electronic circuit determines the state according to a high or low voltage criterion. For example, in the earphone driving circuit, a voltage Vcc between 2.3V~3V is regarded as a high digital level while a voltage Vcc between 0V~0.8V is regarded as a low digital level. Consequently, the detection of a voltage Vcc/2 (about 1.5V) by the detector 240 is roughly midway between a high and a low digital level. This is an ambiguous situation rendering the determination of the earphone plugging/unplugging conditions by the earphone driving circuit difficult.

Because of this, it is difficult to utilize the small earphone driving circuit, such as the one shown in FIG. 2A, with a conventional earphone detection circuit. Hence, to facilitate the deployment of such small earphone driving circuits, an earphone detection circuit is introduced in this invention. Obviously, this invention may also be applied to other types of circuits aside from a small earphone driving circuit.

Figure 3:
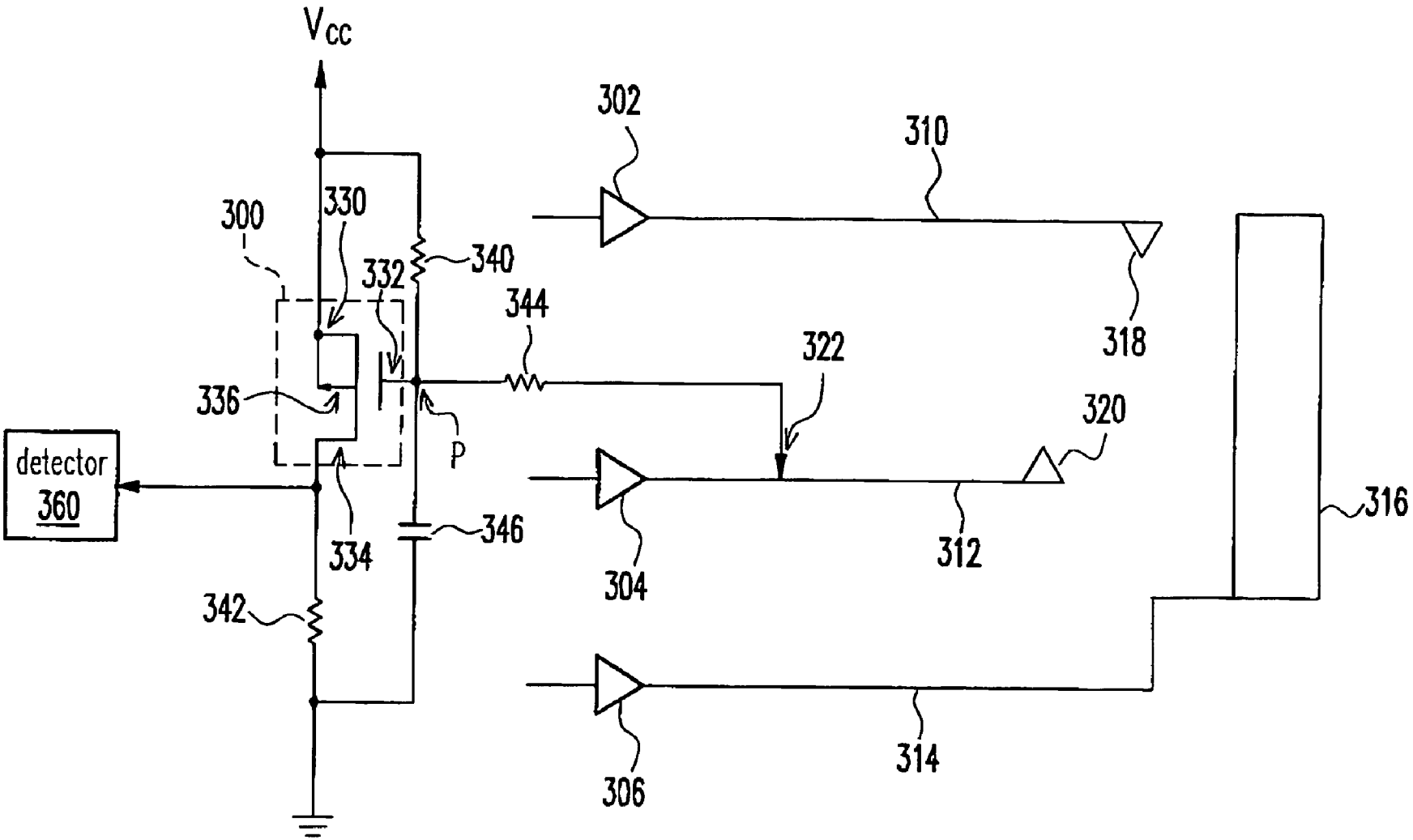
FIG. 3 is a diagram showing a circuit that combines an earphone detection circuit and an earphone driving circuit according to one preferred embodiment of this invention.

FIG. 3 is a diagram showing a circuit that combines an earphone detection circuit and an earphone driving circuit according to one preferred embodiment of this invention. An earphone detection circuit comprising a transistor 300, a plurality of resistors 340, 342 and 344, a capacitor 346 and a detector 360 is shown in FIG. 3. A detection terminal 322 is electrically connected to an audio signal transmission line 312. The transistor 300 has four terminals including a first terminal 330, a second terminal 332, a third terminal 334 and a fourth terminal 336. The first terminal 330 is electrically connected to the fourth terminal 336. Both the first terminal 330 and the fourth terminal 336 receive an operating voltage (Vcc). One end of the resistor 340 is electrically connected to the first terminal of the transistor 300 and the other terminal is electrically connected to the second terminal 332 of the transistor 300. One end of the resistor 342 is electrically connected to the third terminal 334 of the transistor 300 and the other terminal is connected to a ground terminal. One end of the resistor 344 is electrically connected to the second terminal 332 of the transistor 300 and the other terminal is electrically connected to the detection terminal 322. One end of the capacitor 346 is electrically connected to the second terminal 332 of the transistor 300 and the other terminal is connected to the ground terminal. The detector 360 is electrically connected to the third terminal 334 of the transistor 300.

To facilitate explanation, the transistor 300 is a P-type metal-oxide-semiconductor field effect transistor (p-channel MOSFET) in this embodiment. Hence, the four terminals are the source terminal 330, the gate terminal 332, the drain terminal 334 and the substrate terminal 336 respectively. However, P-channel MOSFET is not the only type of transistor that can be used. In fact, any type of transistor having similar voltage conduction characteristics may be used after minor alterations.

Figure 4A:
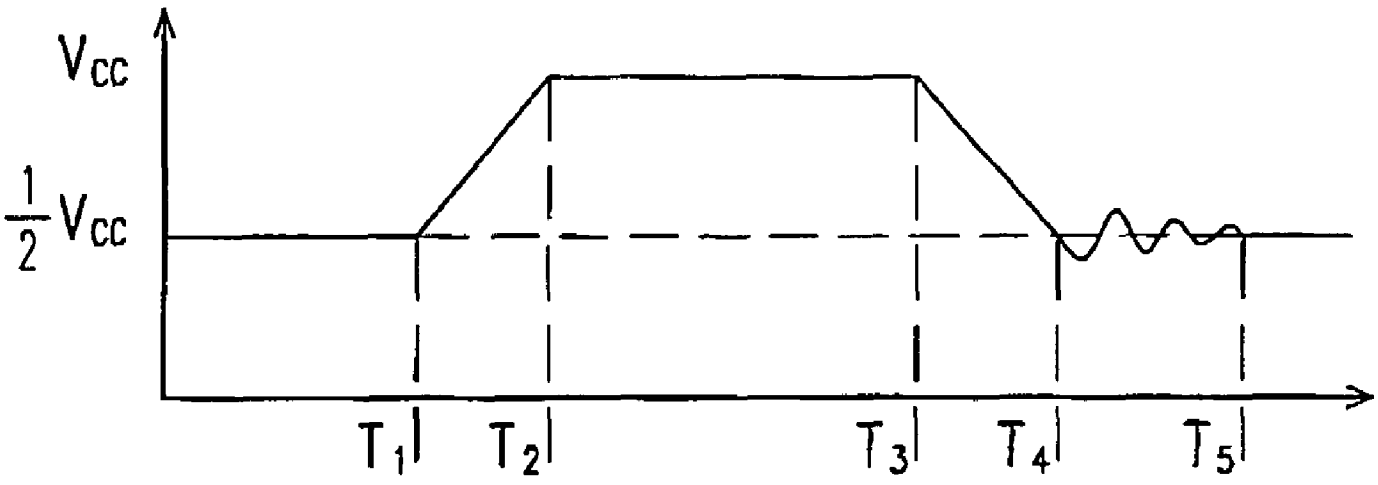
FIG. 4A is a graph showing the voltage variation detected at the transistor gate when earphone is plugged/unplugged using the circuit shown in FIG. 3.
Figure 4B:
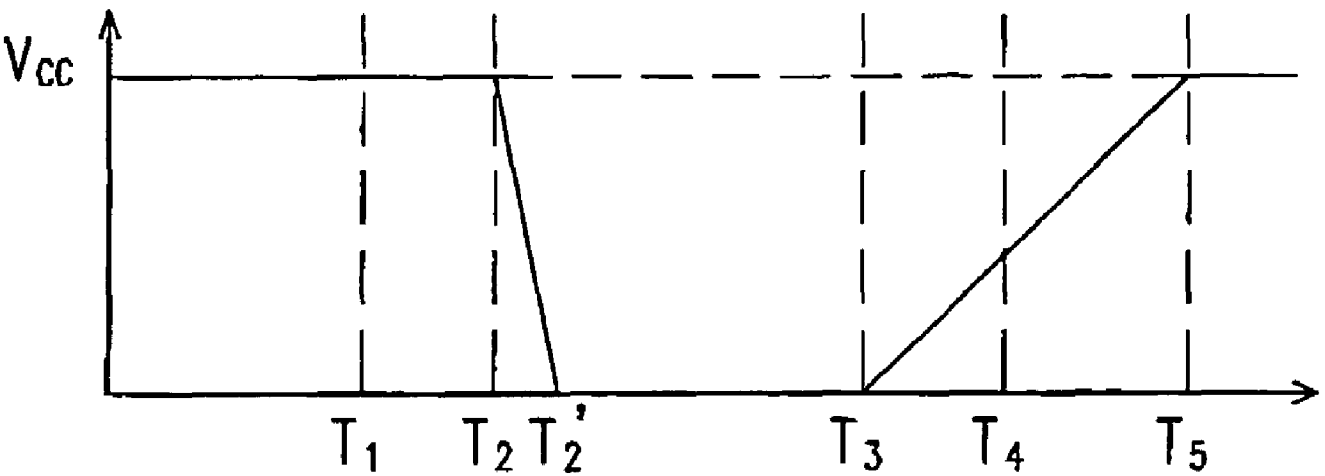
FIG. 4B is a graph showing the voltage variation detected at the detector when earphone is plugged/unplugged using the circuit shown in FIG. 3.

The following is a brief description of the operation of the earphone driving circuit. FIG. 4A is a graph showing the voltage variation detected at the transistor gate (point P) when an earphone is plugged/unplugged using the circuit shown in FIG. 3. FIG. 4B is a graph showing the voltage variation detected at the detector 360 when an earphone is plugged/unplugged using the circuit shown in FIG. 3. Before an earphone plug is inserted into the earphone driving circuit, the detection terminal 322 is electrically connected to the audio signal transmission line 312. In the absence of any audio signal output, the audio signal transmission line 312 is at a voltage level of about Vcc/2. Hence, voltage at the detection terminal 322 is also roughly at Vcc/2. Since resistance of the resistor 340 is considerably larger than the resistance of the resistor 344, voltage level at point P will be slightly larger than Vcc/2 (as shown in FIG. 4A). Consequently, voltage differential between the source terminal 330 and the gate terminal 332 will be slightly smaller than Vcc/2 but sufficiently high to render the transistor 300 conductive. Thus, the detector 360 detects a voltage close to Vcc (as shown in FIG. 4B).

When an earplug is inserted into the earphone driving circuit, the detection terminal 322 is forced away from the audio signal transmission line 312 (at time $T_1$ in FIGS. 4A and 4B). There is a change in potential at point P because the path leading to the detection terminal 322 suddenly becomes a high impedance circuit. The point P starts to charge up the capacitor 346 and raise its potential until the point P reaches a potential close to the voltage Vcc (at time $T_2$ in FIG. 4A). As point P approaches the voltage Vcc, the transistor 300 gradually shuts down. Hence, voltage detected by the detector 360 (or potential at the drain terminal 334) gradually falls to zero (at time $T_2$ "in FIG. 4B) and the detector 360 detects the presence of an earphone. As soon as the detector 360 detects the presence of an earphone, audio signals are immediately transmitted to the user earphone through the earphone driving circuit.

Between the period $T_2$ to $T_3$, the earphone is plugged into the earphone driving circuit and a voltage Vcc is maintained at point P. At time $T_3$, the earplug is removed from the earphone driving circuit. Hence, the detection terminal 322 is electrically connected to the audio signal transmission line 312 again. Since voltage at the detection terminal 322 is roughly equivalent to the sum of Vcc/2 and the voltage of the audio signal, potential at point P starts to drop (time period between $T_3$ and $T_5$ as shown in FIG. 4A). Due to resistance-capacitor effect of the earphone detection circuit, there is transient variation in voltage at point P before settling to a stable value (time period between $T_4$ and $T_5$ in FIG. 4A). Furthermore, as the potential at point P drops, voltage differential between the gate terminal 332 and the source terminal 330 gradually increases so that the transistor 300 becomes conductive. Ultimately, voltage (potential at the drain terminal 334) detected by the detector 360 rises to a level close to Vcc. Consequently, the detector 360 detects the absence of an earplug inside the earphone driving circuit and re-routes its audio signals to another circuit instead of the earphone driving circuit.

Figure 5:
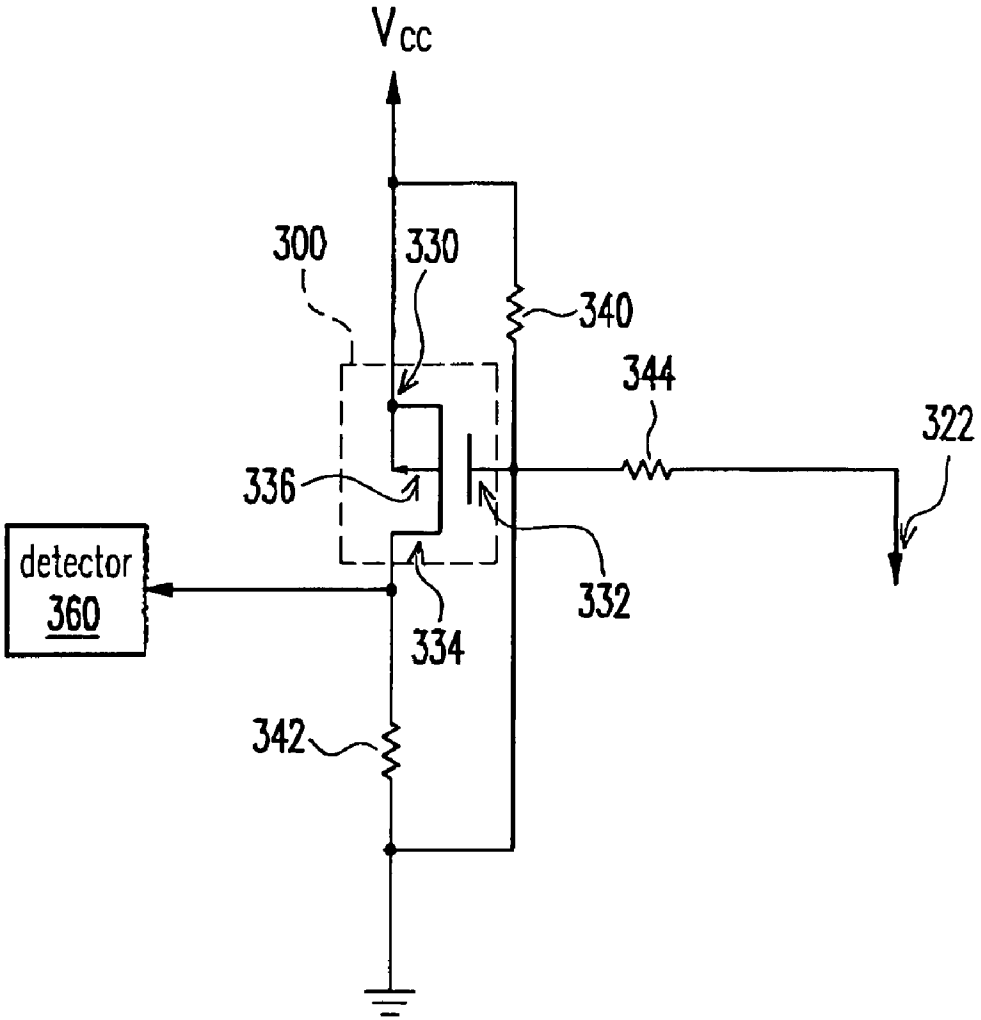
FIG. 5 is a diagram of an earphone detection circuit according to a second preferred embodiment of this invention.

In an alternative embodiment, even the capacitor 346 can be eliminated. FIG. 5 is a diagram of an earphone detection circuit according to a second preferred embodiment of this invention. In FIG. 5, elements identical to the ones shown in FIG. 3 are labeled identically. The earphone detection circuit in FIG. 5 operates in a similar mode as the one in FIG. 3 and hence detailed explanation is omitted. Note, however, that dimension of the earphone detection circuit is reduced despite a minor increase in resistor-capacitor effect.

In conclusion, this invention utilizes the voltage conduction characteristic of a transistor to facilitate the attachment of an earphone detection circuit to an earphone driving circuit formerly incapable of detecting plugging/unplugging status. In addition, overall dimension of the earphone detection circuit is reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

The invention claimed is:

1. An earphone detection device suitable for use in detecting an plug/unplug status of an earphone from an earphone driving circuit that has a detection terminal, the earphone detection device comprising:

a transistor having a first terminal, a second terminal, a third terminal and a fourth terminal, wherein the first terminal and the fourth terminal are electrically connected and both electrically connected to an operating voltage;

a first resistor having a first terminal and a second terminal, wherein the first terminal is electrically connected to the first terminal of the transistor and the second terminal is electrically connected to the second terminal of the transistor;

a second resistor having a first terminal and a second terminal, wherein the first terminal is electrically connected to the third terminal of the transistor and the second terminal is electrically connected to a ground terminal;

a capacitor having a first terminal electrically connected to the second terminal of the transistor and a second terminal electrically connected to the ground terminal;

a third resistor having a first terminal and a second terminal, wherein the first terminal is electrically connected to the second terminal of the transistor and the second terminal electrically connected to the detection terminal; and a detector electrically connected to the third terminal of the transistor.

2. The earphone detection device of claim 1, wherein the transistor includes a p-channel metal-oxide-semiconductor field effect transistor (p-channel MOSFET).

3. The earphone detection device of claim 2, wherein the first terminal is a source terminal, the second terminal is a gate terminal, the third terminal is a drain terminal and the fourth terminal is a substrate terminal.

4. An earphone detection device suitable for use in detecting a connection status of an earphone to a driving circuit, the earphone detection device comprising:

a transistor having a first terminal, a second terminal, a third terminal and a fourth terminal, wherein the first terminal and the fourth terminal are electrically connected to an operating voltage and the third terminal is electrically connected to a ground terminal;

a first resistor having a first terminal and a second terminal, wherein the first terminal is electrically connected to the first terminal of the transistor and the second terminal is electrically connected to the second terminal of the transistor;

a second resistor having a first terminal and a second terminal, wherein the first terminal is electrically connected the third terminal of the transistor and the second terminal is electrically connected to the ground terminal;

a third resistor having a first terminal and a second terminal, wherein the first terminal is electrically connected to the second terminal of the transistor and the second terminal is electrically connected to a detection terminal of the driving circuit; and a detector electrically connected to the third terminal of the transistor.

5. The earphone detection device of claim 4, wherein the transistor includes a p-channel metal-oxide-semiconductor field effect transistor (p-channel MOSFET).

6. The earphone detection device of claim 5, wherein the first terminal is a source terminal, the second terminal is a gate terminal, the third terminal is a drain terminal and the fourth terminal is a substrate terminal.

7. A connection detecting device with a detection circuit for detecting a connection status of an earphone to an earphone driving circuit, the earphone driving circuit having a detection terminal, the connection detecting device comprising:

a transistor having a first terminal, a second terminal, a third terminal and a fourth terminal, wherein the first terminal and the fourth terminal are electrically connected to an operating voltage and the third terminal is electrically connected to a ground terminal;

a first resistor having a first terminal and a second terminal, wherein the first terminal is electrically connected to the first terminal of the transistor and the second terminal is electrically connected to the second terminal of the transistor;

a second resistor having a first terminal and a second terminal, wherein the first terminal is electrically connected the third terminal of the transistor and the second terminal is electrically connected to the ground terminal;

a third resistor having a first terminal and a second terminal, wherein the first terminal is electrically connected to the second terminal of the transistor and the second terminal is electrically connected to the detection terminal; and a detector electrically connected to the third terminal of the transistor;

wherein the first resistor has a resistance considerably greater than the resistance of the second resistor.

8. The connection detecting device of claim 7, further including a capacitor that has a first terminal and a second terminal such that the first terminal of the capacitor is electrically connected to the second terminal of the transistor and the second terminal of the capacitor is electrically connected to the ground terminal.

9. The connection detecting device of claim 8, wherein the transistor includes a p-channel metal-oxide-semiconductor field effect transistor (p-channel MOSFET).

10. The connection detecting device of claim 9, wherein the first terminal is a source terminal, the second terminal is a gate terminal, the third terminal is a drain terminal and the fourth terminal is a substrate terminal.

11. The connection detecting device of claim 7, wherein the transistor includes a p-channel metal-oxide-semiconductor field effect transistor (p-channel MOSFET).

12. The connection detecting device of claim 11, wherein the first terminal is a source terminal, the second terminal is a gate terminal, the third terminal is a drain terminal and the fourth terminal is a substrate terminal.

* * * * *